US012077247B2

(12) United States Patent
Mazzarelli

(10) Patent No.: US 12,077,247 B2
(45) Date of Patent: Sep. 3, 2024

(54) INFLATABLE BIMINI TOP

(71) Applicant: Commercial Sewing, Inc., Torrington, CT (US)

(72) Inventor: David Mazzarelli, Torrington, CT (US)

(73) Assignee: COMMERCIAL SEWING, INC., Torrington, CT (US)

( * ) Notice: Subject to any disclaimer, the term of this patent is extended or adjusted under 35 U.S.C. 154(b) by 394 days.

(21) Appl. No.: 17/483,254

(22) Filed: Sep. 23, 2021

(65) Prior Publication Data

US 2022/0111932 A1 Apr. 14, 2022

Related U.S. Application Data

(60) Provisional application No. 63/083,161, filed on Sep. 25, 2020.

(51) Int. Cl.
*B63B 17/02* (2006.01)
*E04H 15/20* (2006.01)

(52) U.S. Cl.
CPC ..... *B63B 17/02* (2013.01); *E04H 15/20* (2013.01); *E04H 2015/201* (2013.01)

(58) Field of Classification Search
CPC ..... E04H 15/20; E04H 2015/201
See application file for complete search history.

(56) References Cited

U.S. PATENT DOCUMENTS 5,070,807 A * 12/1991 Lewis ..... B63B 17/02 114/361
6,623,322 B1 * 9/2003 Lesniak ..... B63B 7/085 114/361
7,424,862 B1 * 9/2008 Wagner ..... B63B 17/02 114/364
2022/0389734 A1 * 12/2022 Woolsey ..... E04F 10/02

FOREIGN PATENT DOCUMENTS

AU 2016200614 B2 * 8/2017 ..... B63B 17/02
WO WO-2015013768 A1 * 2/2015 ..... B63B 17/02
WO WO-2023044088 A1 * 3/2023

* cited by examiner

*Primary Examiner* — S. Joseph Morano
*Assistant Examiner* — Jovon E Hayes
(74) *Attorney, Agent, or Firm* — CANTOR COLBURN LLP

(57) ABSTRACT

A bimini for a boat includes a cover mountable to the boat and an inflation system arranged in fluid communication with the bimini. The bimini is transformable between a stowed position, a retracted position, and an extended position. The bimini is transformable between the retracted position and the extended position via operation of the inflation system.

16 Claims, 4 Drawing Sheets

INFLATABLE BIMINI TOP

CROSS-REFERENCE TO RELATED APPLICATIONS

This application claims the benefit of U.S. Application No. 63/083,161 filed Sep. 25, 2020, the disclosure of which is incorporated herein by reference in its entirety.

FIELD

The present invention generally relates to convertible top covers for boats, commonly called bimini tops, and more particularly to an improved inflatable bimini top device.

BACKGROUND

In recreational boating, the so-called "bimini top" is a convertible cover erected upon the deck of a watercraft, such as a boat for example, and made to be deployed at an elevation comfortably above the heads of the passengers. The standard type of bimini top and those convertible boat covers of the same nature generally comprise a flexible canvas material secured to a foldable support frame that is erected across the deck and pivotally attached thereto. These standard types of foldable bimini tops can be raised when needed or lowered into a substantially flat position upon the deck when not in use or when an overhead obstruction may otherwise require its lowering. Deployment of these foldable bimini tops is often done manually but has been designed to be power driven as well. Regardless of their specific foldable structure or method of operational deployment, the installation and utilization of bimini tops have become increasingly important for the protection of passengers and crew on board boats against excessive sun exposure and the evident risks of skin cancer caused thereby.

Existing framework generally used to construct present bimini top installations includes a system of poles or like rigid members mounted to the port and starboard sides of the boat and made to extend across the deck at a sufficient height level to support the canvas top overhead the occupants. As currently arranged and implemented, these pole systems typically have separate front and rear pole members over which the canvas top is extended and, depending upon the length of the top from fore to aft, one or more additional pole members are needed and disposed between the front and rear poles to firmly support the intermediate section of the top. Although these pole systems may be pivotally mounted to the boat deck so that they can be folded down and lowered out of the way when the bimini top is not needed, the pole members may still obstruct a person on board from reaching out over the side of the boat when fishing, docking or mooring the boat and further present an obstacle in boarding and loading equipment onto the deck. While these and other similarly devised implementations of convertible bimini tops have been effective in providing suitable shade protection from the sun when needed, they are also costly. Moreover, they have not satisfactorily resolved the problems of obstructions and obstacles caused in and around the boat deck by their supporting framework nor have they provided a completely hands free system of operation both in extended deployment and retracted storage of the bimini top.

Hence, what is needed is an improved bimini top having ease of use and simplicity that effectively limits sun exposure.

BRIEF DESCRIPTION

According to an embodiment, a bimini for a boat includes a cover mountable to the boat and an inflation system arranged in fluid communication with the bimini. The bimini is transformable between a stowed position, a retracted position, and an extended position. The bimini is transformable between the retracted position and the extended position via operation of the inflation system.

According to an embodiment, a boat includes bimini including a cover transformable between a stowed position, a retracted position and an extended position. The bimini is mountable about the boat. An inflation system is arranged in fluid communication with the bimini. The inflation system is operable to transform the cover from the retracted position to the extended position.

BRIEF DESCRIPTION OF THE DRAWINGS

The following descriptions should not be considered limiting in any way. With reference to the accompanying drawings, like elements are numbered alike:

FIG. 3*b* illustrates an exploded view of the inflated beams having stitches with air gaps there between.

DETAILED DESCRIPTION

A detailed description of one or more embodiments of the disclosed apparatus and method are presented herein by way of exemplification and not limitation with reference to the Figures.

Figure 1:
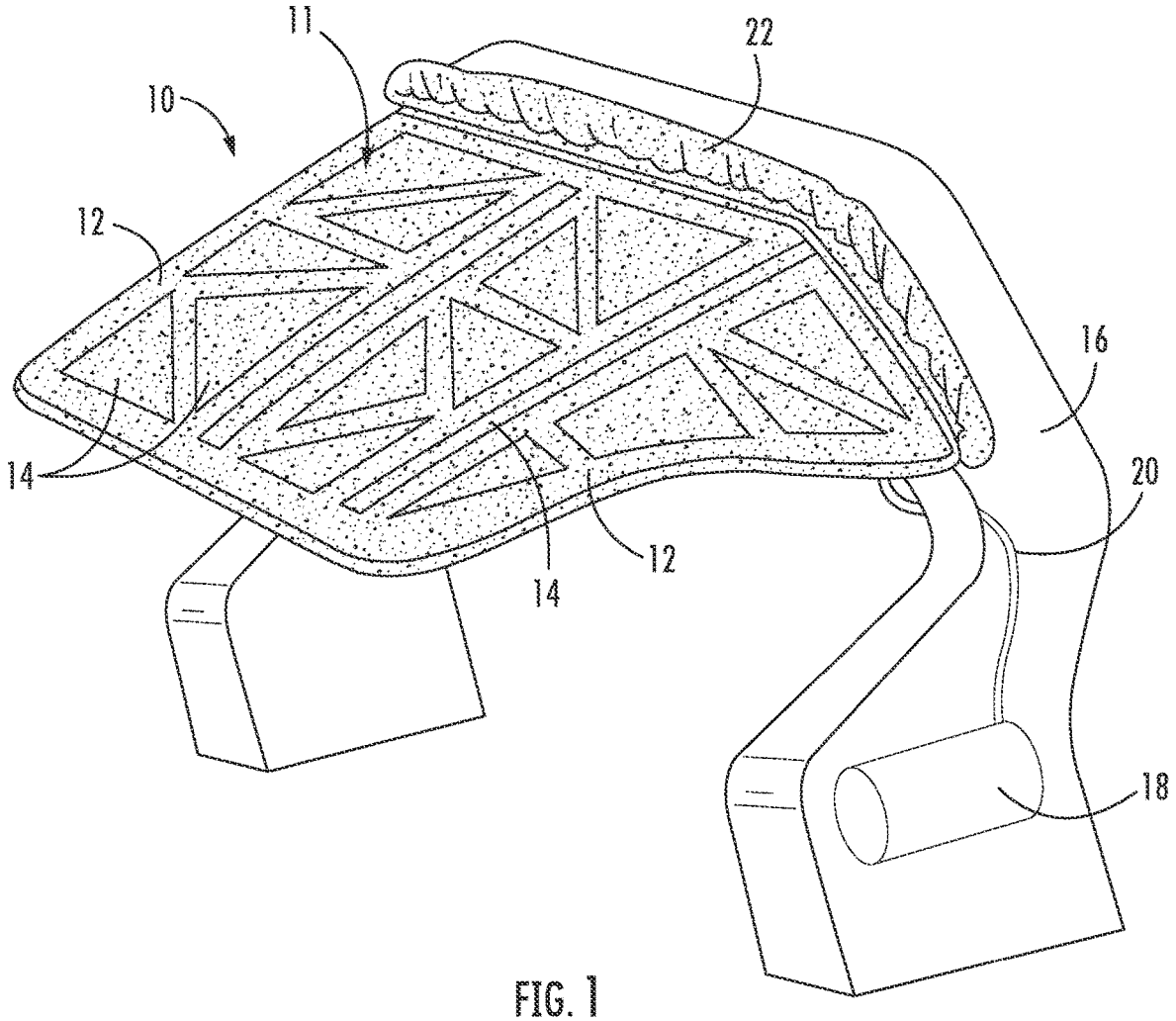
FIG. 1 illustrates an exemplary inflatable bimini top of the present invention.

Referring now to the Figures, there is shown in FIG. 1 an inflatable bimini system 10 for use with a vehicle, such as a watercraft or boat for example. The bimini system 10 includes a cover 11 that is typically transformable between a retracted position and an extended position. As shown in the non-limiting embodiment of FIG. 1, the cover 11 may be supported by a tower 16. The tower 16 is affixed to any conventional boat (not shown). In addition, the bimini system 10 includes an inflation system 18, such as an auxiliary air tank for example, configured to provide air to the bimini top 10. However, it should be understood that any suitable inflation system, such as an air compressor or pump for example, is within the scope of the disclosure. The cover 11 is fluidly connected to the inflation system 18 such as by a hose 20. During use, the user would operate the inflation system 18 to provide air to the cover 11, causing the cover 10 to inflate and transform from a deflated, retracted position to an extended, fully open position. In the extended, fully open position, the cover 11 extends beyond a leading or trailing edge of the tower 16.

As fully appreciated, the inflation system 18 may be manually operated, such as, by use of a hand-held pump or alternatively, may be automatic in nature. Any number of methods of inflating/deflating the cover 11 as desired is envisaged by the present disclosure. In an embodiment, the cover 11, when deflated or in the retracted position, may be stowed. In such embodiments, a storage pouch 22 may be located about the tower 16 and configured to receive the retracted cover. Accordingly, in operation, a user would completely deflate the cover 11 and then stow the cover 11 in the pouch 22.

In an embodiment, the cover 11 includes inflated beams 12 and zones of flat portions 14. In operation, the inflation system 18 is configured to provide air through the hose 20, which is then introduced into the beams 12 thus inflating the beams 12 and causing the cover to transform to an erect, the open state. In an embodiment, as shown, the beams 12 are provided substantially around a periphery thereof, and selected interior areas of the overall cover 11 to create a suitable, defined structure. However, embodiments where the beams 12 are located at other regions of the cover 11 are also contemplated herein. Moreover, the inflated beams 12 may be shaped so as to create various desired zones of flat portions 14. In this way, any number of various sizes/shapes of the cover 11 can be created. When fully inflated, the beams 12 and flat portions 14 cooperate to provide a defined structure as appropriate.

Figure 2:
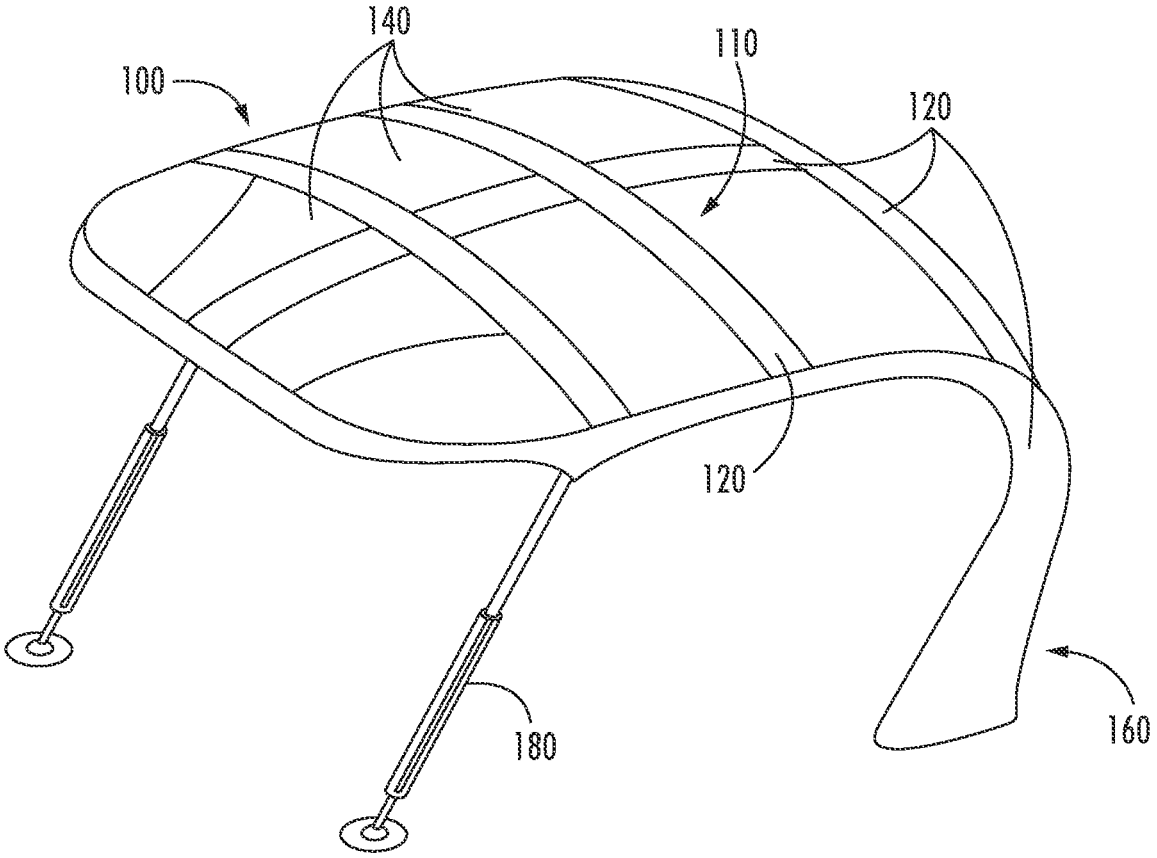
FIG. 2 illustrates another exemplary inflatable bimini top of the present invention.

Referring now to FIG. 2, an exemplary inflatable bimini system 100 according to another embodiment is illustrated. As can be seen, in this embodiment, there is no physical support or tower for the bimini cover 110. Rather, the entire structure of the bimini cover 110, which includes a generally horizontally extending first portion, and additionally includes a second portion or base 160 that extends at an angle, such as substantially perpendicular to the first portion for example, is inflatable. In addition, although not shown, there is provided an auxiliary inflation system 18 for providing air to the bimini cover 110. The bimini cover 110 is connected to the inflation system 18 by a hose 20. During use, the user would operate the inflation system 18 to provide air to the bimini cover 110, and transform the bimini cover 110 from either a stowed or retracted position to a fully open position.

As in the previous embodiment, the inflation system 18 may be manually operated, such as, by use of a hand-held pump or automatic in nature. Any number of methods of inflating/deflating the bimini cover 110 as desired is envisaged by the disclosure. In an embodiment, the boat may further include a storage unit (not shown) for storing the bimini cover 110 when not in use. In this state, the user would completely deflate the bimini top 100, potentially separate the bimini cover 110 from the deck or other connection points of the boat, and stow the bimini cover 110 away in the storage unit.

As previously described, the bimini cover 110 may include inflated beams 120 and zones of flat portions 140. In operation, the inflation system 18 would introduce air into the beams 120 via hose 20, causing the beams 120 to inflate and creating an erect cover in the open state. The beams 120 are ideally provided substantially around a periphery of the bimini cover 110, and selected interior areas of the bimini cover 110 to create a suitable, defined structure. Moreover, the inflated beams 120 are ideally shaped so as to create desired, various zones of flat portions 140. In this way, any number of various sizes/shapes of the bimini cover 110 can be created. When fully inflated, the beams 120 and flat portions 140 in combination provide a defined structure as appropriate. The bimini cover 110 may be ideally held in place or affixed to the boat via any suitable means, including but not limited to straps 180.

Figure 3A:
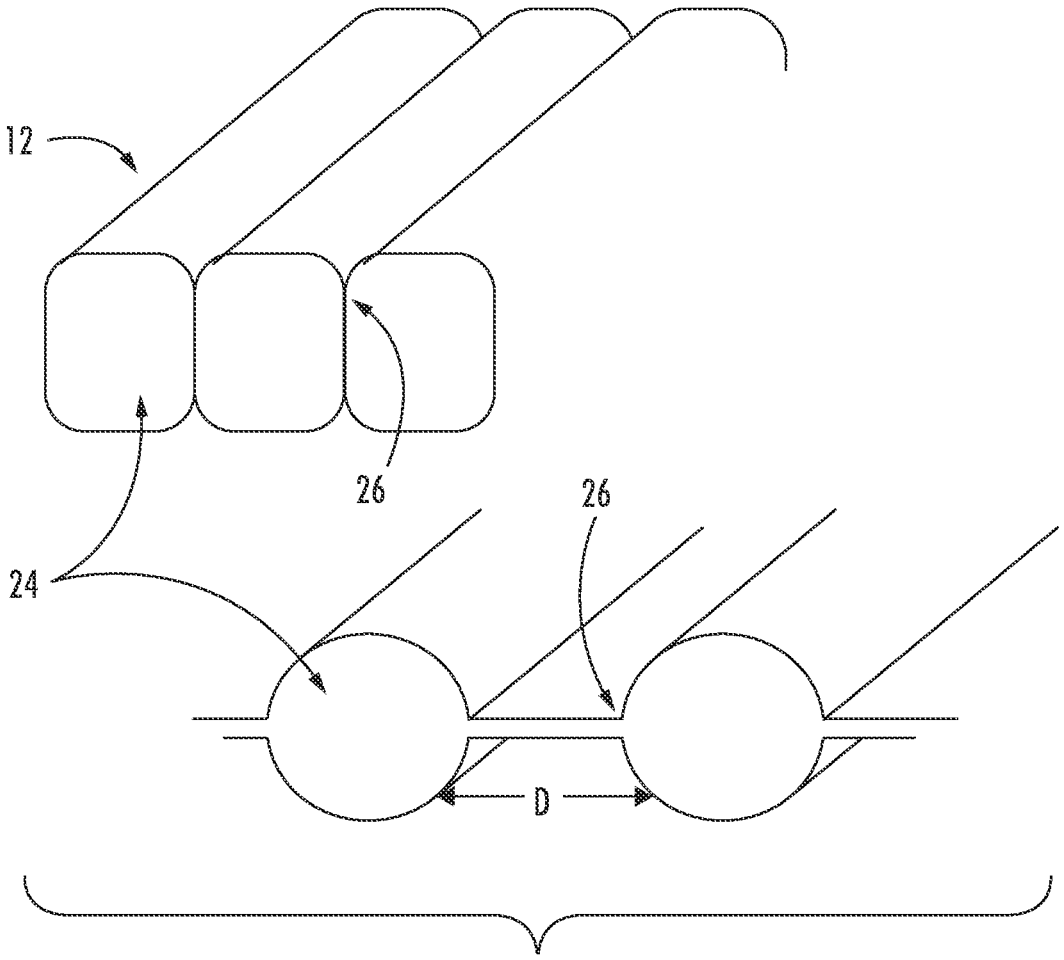
FIG. 3*a* illustrates an exploded view of the inflated beams having air chambers therein.

Referring now to FIG. 3*a*, there is shown an exploded view of the inflated beams 12. Note, any discussion of the beams 12 and flat portions 14 is also applicable to the beams 120 and flat portions 140. As shown, beams 12 may include an array of multiple air chambers 24 that are adhered, such as via a glue or other adhesive, or welded together by welds 26. Welding can be accomplished by any preferred method as desired, including die-electric and constant heat. Note, any number of shapes and sizes of the air chambers 24 may be used, including substantially oval or circular air chambers 24, as depicted. In addition, any degree of separation D between the air chambers 24 is contemplated herein. Moreover, the separation D between adjacent air chambers 24 may be equidistant, varied or any combination thereof depending on the desired structure and characteristics of the bimini 12.

Figure 3B:
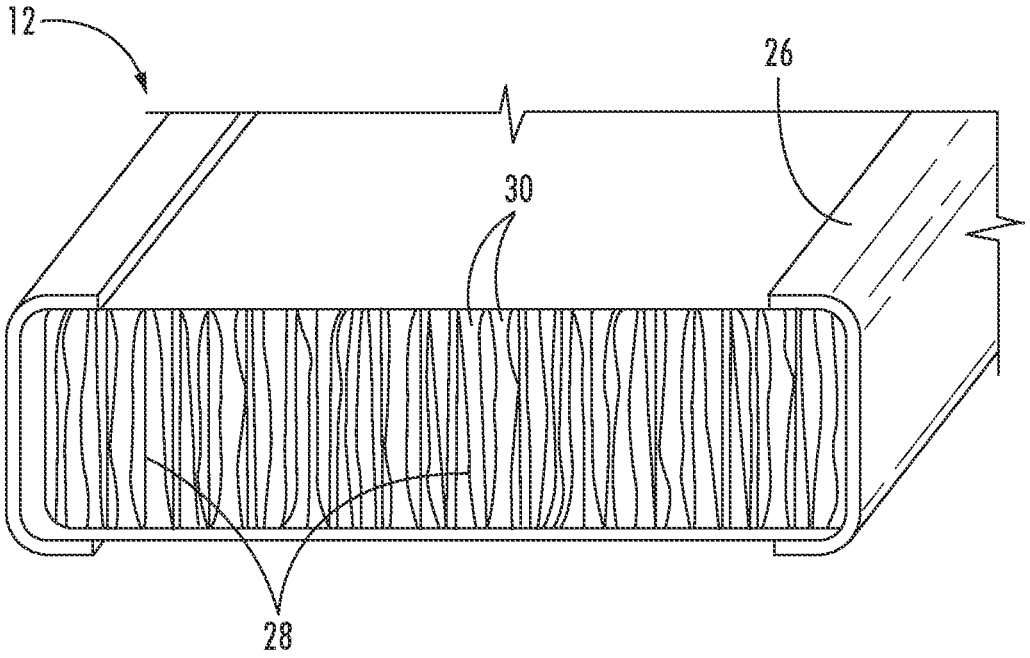

Referring now to FIG. 3*b*, there is shown an exploded view of an embodiment of a portion of the bimini 10, such as the inflated beams 12 for example. As shown, beams 12 include an array of multiple air gaps 30 that are defined or created by stitches 28 (e.g., "drop-stitch technology"). However, it should be understood that any portion of the bimini configured to receive air may include this drop-stitch technology. Each of the arrays within the beams 12 may be adhered via an adhesive, such as glue for example, or welded together by welds 26. Welding can be accomplished by any preferred method as desired, including die-electric and constant heat, as previously discussed. Note, any number of shapes and sizes of the air gaps 30 (defined by the stitches 28) may be used, including substantially linear air gaps 30, as depicted. In addition, each of the air gaps 30 may have any length or width, to accommodate any number of suitable applications and conditions required during use.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A bimini for a watercraft, comprising:

a cover mountable to the watercraft; and an inflation system arranged in fluid communication with the bimini;

wherein the bimini is transformable between a stowed position, a retracted position, and an extended position, and the bimini is transformable between the retracted position and the extended position via operation of the inflation system, wherein the cover comprises zones of inflated beams and flat portions, and wherein the inflated beams comprise stitches with air gaps there between.

2. The bimini of claim 1, wherein the inflated beams comprise air chambers.

3. The bimini of claim 2, wherein the air chambers are welded together.

4. The bimini of claim 1, wherein the cover is mountable to a tower structure of the watercraft.

5. The bimini of claim 4, wherein in the stowed position, the cover is affixed to the tower structure.

6. The bimini of claim 5, further comprising a storage pouch provided on the tower for storing the bimini during non-use, and when in the stowed position, the cover is positionable within a storage unit of the watercraft.

7. The bimini of claim 1, wherein the inflation system includes an air tank and a hose, the air tank being fluidly coupled to the cover via the hose.

8. The bimini of claim 1, wherein the bimini is affixed to the watercraft via straps.

9. The bimini of claim 1, wherein the cover includes a base, the base being inflatable via the inflation system.

10. A watercraft, comprising:

a bimini including a cover transformable between a stowed position, a retracted position and an extended position, the bimini being mountable about the boat; and an inflation system arranged in fluid communication with the bimini, the inflation system being operable to transform the cover from the retracted position to the extended position, wherein the bimini comprises zones of inflated beams and flat portions, and wherein the inflated beams comprise stitches with air gaps there between.

11. The watercraft of claim 10, wherein the inflated beams comprise air chambers.

12. The watercraft of claim 11, wherein the air chambers are welded together.

13. The watercraft of claim 10, wherein the inflation system includes an air tank fluidly connected to the bimini via a hose.

14. The watercraft of claim 13, wherein the cover is stowable when in the retracted position.

15. The watercraft of claim 10, wherein the watercraft further comprises a tower structure and the cover is affixed to the tower structure when stowed.

16. The watercraft of claim 10, wherein the bimini is affixed to the watercraft by at least one strap.

* * * * *